US010973330B2

(12) United States Patent
Scarlett

(10) Patent No.: US 10,973,330 B2
(45) Date of Patent: Apr. 13, 2021

(54) LATERAL SUPPORT FOR A SEAT

(71) Applicant: ROLAPAL LIMITED, Auckland (NZ)

(72) Inventor: Roydon Mark Scarlett, Auckland (NZ)

( * ) Notice: Subject to any disclaimer, the term of this patent is extended or adjusted under 35 U.S.C. 154(b) by 0 days.

(21) Appl. No.: 16/493,703

(22) PCT Filed: Mar. 7, 2018

(86) PCT No.: PCT/NZ2018/050024
§ 371 (c)(1),
(2) Date: Sep. 12, 2019

(87) PCT Pub. No.: WO2018/169414
PCT Pub. Date: Sep. 20, 2018

(65) Prior Publication Data

US 2020/0029694 A1 Jan. 30, 2020

(30) Foreign Application Priority Data

Mar. 13, 2017 (NZ) ..... 730007

(51) Int. Cl.
*A47C 7/40* (2006.01)
*A61G 5/12* (2006.01)
(Continued)

(52) U.S. Cl.
CPC ..... *A47C 7/40* (2013.01); *A47C 7/425* (2013.01); *A61G 5/12* (2013.01); *A61G 5/122* (2016.11);
(Continued)

(58) Field of Classification Search
CPC .. A61G 5/12; A61G 5/1091; Y10T 16/450243
(Continued)

(56) References Cited

U.S. PATENT DOCUMENTS 3,640,571 A * 2/1972 Keropian ..... A61G 5/12 297/464
3,704,910 A * 12/1972 Willcott ..... A47C 1/03 297/464
(Continued)

FOREIGN PATENT DOCUMENTS

CN 202478013 10/2010

OTHER PUBLICATIONS

Simon Ochsenbein "International Preliminary Report on Patentability—International Patent Application No. PCT/NZ2018/050024" Australian Patent Office; dated Jul. 16, 2019; pp. 1-5.

*Primary Examiner* — Robert Canfield
(74) *Attorney, Agent, or Firm* — Nicholas J. Landau; Bradley Arant Boult Cummings LLP

(57) ABSTRACT

In a preferred form the invention there is a lateral support forming part of a seat of a wheelchair, comprising a bracket (1), a hinge body (2), a forward plate (3) having padding and a lever (17). The lever (17) is arranged so it can be turned by hand to move a bolt (18) into a pin (5) whereby the hinge body is prevented from swinging about the pin. The lever (17) is also arranged so it can be subsequently turned by hand to cause a cam face (21) of the lever to ride along a complimentary engaging surface (22) of the hinge body. This forces the bolt (18) from the pin (5) thereby freeing the hinge body (2) to swing about the pin (5) and, as a consequence, to swing the plate (3) to facilitate access to the seat.

10 Claims, 3 Drawing Sheets

(51) Int. Cl.
*A61G 5/14* (2006.01)
*A47C 7/42* (2006.01)

(52) U.S. Cl.
CPC ..... *A61G 5/14* (2013.01); *Y10S 297/04* (2013.01); *Y10T 16/5407* (2015.01); *Y10T 16/540243* (2015.01); *Y10T 16/540247* (2015.01)

(58) Field of Classification Search
USPC ..... 297/464, DIG. 4, 330, 406, 452.4, 297/DIG. 10
See application file for complete search history.

(56) References Cited

U.S. PATENT DOCUMENTS 4,073,537 A * 2/1978 Hammersburg ..... A61G 5/12 297/464
5,362,082 A * 11/1994 Kornberg ..... A61G 5/12 248/285.1
5,678,798 A * 10/1997 Little ..... A61G 5/10 16/324
6,045,183 A * 4/2000 Weber ..... B60N 2/2839 297/173
6,361,118 B1 * 3/2002 Melgarejo ..... A61G 5/12 16/324
6,460,927 B1 10/2002 Groth
6,460,933 B1 * 10/2002 Bors ..... A61G 5/1067 297/284.9
9,198,814 B2 12/2015 Paul et al.
9,717,637 B2 * 8/2017 Bucher ..... A61G 5/124
10,194,745 B2 * 2/2019 DuFresne ..... A61G 5/10
2006/0131833 A1 6/2006 Nelson et al.
2015/0202103 A1 * 7/2015 Olst ..... A61G 5/1064 297/423.32
2017/0087037 A1 * 3/2017 Scarlett ..... A61G 5/121

* cited by examiner

LATERAL SUPPORT FOR A SEAT

CROSS-REFERENCE TO RELATED APPLICATIONS

This application is a national stage under 35 U.S.C. 371 of International Application No. PCT/NZ2018/050024 having an international filing date of Mar. 7, 2018 (currently published). International Application No. PCT/NZ2018/050024 cites the priority of New Zealand Patent No. 730007, issued Mar. 23, 2018 (granted).

FIELD OF THE INVENTION

A preferred form of the invention relates to a seat having a lateral pad support.

BACKGROUND

It is known for wheelchairs to have lateral pads for supporting the sides of the torso of a human user. It is convenient for the pads to be swung out of the way to enable the user easy access to the chair, and then swung back closer to the body and locked in place. It is an object of a preferred form of the invention to go at least some way towards achieving this. However it should be understood that the invention has more general applicability and that any objects or advantages of the preferred embodiment should not be seen as a limitation on the claims. The object of the invention per se is simply to provide the public with a useful choice.

The term comprising, if and when used in this document in relation to a combination of features, should be interpreted to mean that the combination may be supplemented by additional features, but does not have to be.

SUMMARY OF INVENTION

According to one aspect of the invention there is provided a lateral support forming part of a seat, comprising:

a) a bracket;

b) a hinge body;

c) a forward support having padding; and d) a lever;

the lever arranged so it can be turned by hand to move a bolt into a pin whereby the hinge body is prevented from swinging about the pin, the lever also arranged so it can be subsequently turned by hand to cause a cam surface of the lever to ride along a complimentary surface of the hinge body to force the bolt from the pin thereby freeing the hinge body to swing about the pin and, as a consequence, to swing the forward support to facilitate access to the seat.

Preferably the cam surface of the lever and the complimentary surface of the hinge body are similarly or identically angled.

Preferably the pin extends substantially vertically and the bolt extends substantially horizontally.

Preferably the bolt is spring biased towards the pin.

Preferably the forward support can be swung about a second pin and releasably locked at a desired angle by fixing members (eg screws).

Preferably the forward support comprises a padded plate.

Preferably the hinge body and the forward support can be collective swung by applying a swinging force to the lever when the bolt has been forced from the pin.

Preferably the bracket has upper and lower legs turn back on themselves and extend around upper and lower ends of the pin and are tightened against the pin by way of threaded fixing members (e.g. screws).

Preferably the hinge body has forwardly disposed upper and lower arms that turn back on themselves and extend around upper and lower ends of the second pin and are tightened against the second pin by way of threaded fixing members (eg screws).

DRAWINGS

Some preferred embodiments of the invention will now be described by way of example and with reference to the accompanying drawings, of which:

DETAILED DESCRIPTION

Figure 1:
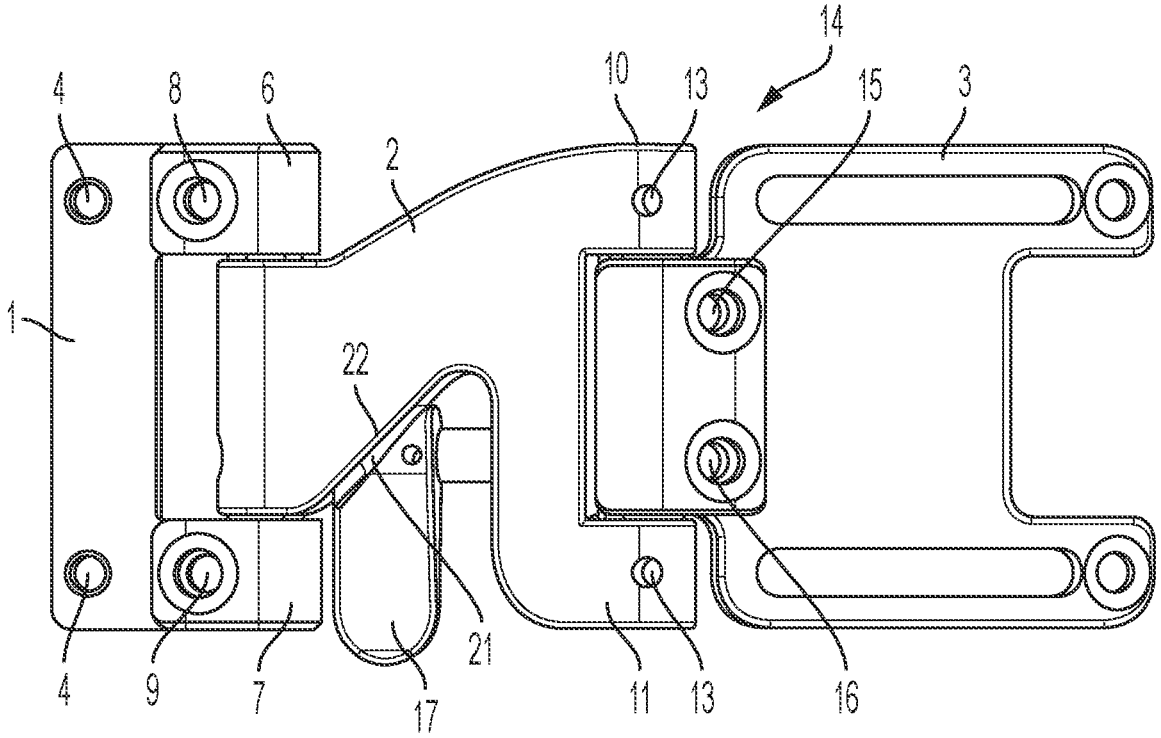
FIG. 1 is an isometric view of a lateral pad support for a wheelchair.
Figure 2:
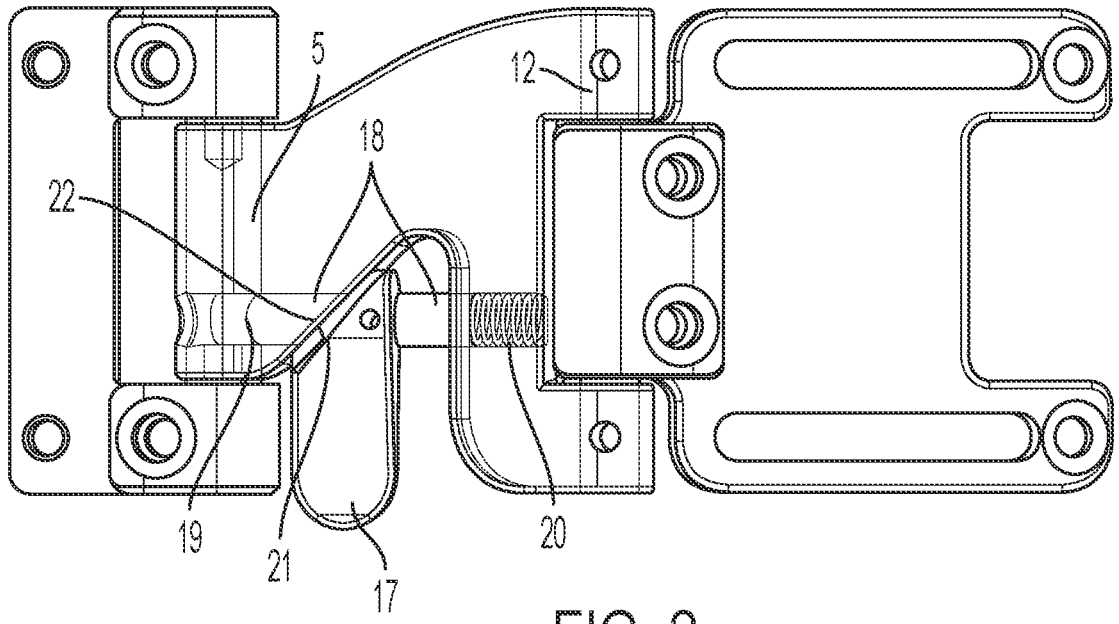
FIG. 2 is a further isometric partially internal view of the support, when in a locked state.

Referring to FIGS. 1 and 2, the lateral support has bracket 1, a hinge body 2 and a forward plate 3. The bracket 1 is secured to the backrest frame of a wheelchair by applying screws through apertures 4. The hinge body 2 is secured to the bracket 1 by way of a vertical pin 5 extending between upper and lower legs 6, 7 of the bracket. More specifically, each leg 6, 7 loops back on itself and the pin 5 sits inside each loop. The loops are tightened by way of screws (not shown) in apertures 8, 9 to help retain the pin 5. The arrangement is such that the hinge body 2 is able to swing on the pin 5.

The forward end of the hinge body 2 has upper and lower arms 10, 11 supporting a vertically extending pin 12. The pin is locked with respect to the arms 10, 11 by way of screws or horizontal pins (not shown) passing through aligned holes 13. One end 14 of the plate 3 wraps around the pin 12 between the arms 10, 11 and can be tightened against the pin 12 by way of screws (not shown) passing through apertures 15, 16 therein. The angle of the plate 3 can be adjusted by swinging it about the pin 12 and then tightening the screws to lock it there.

Figure 6:
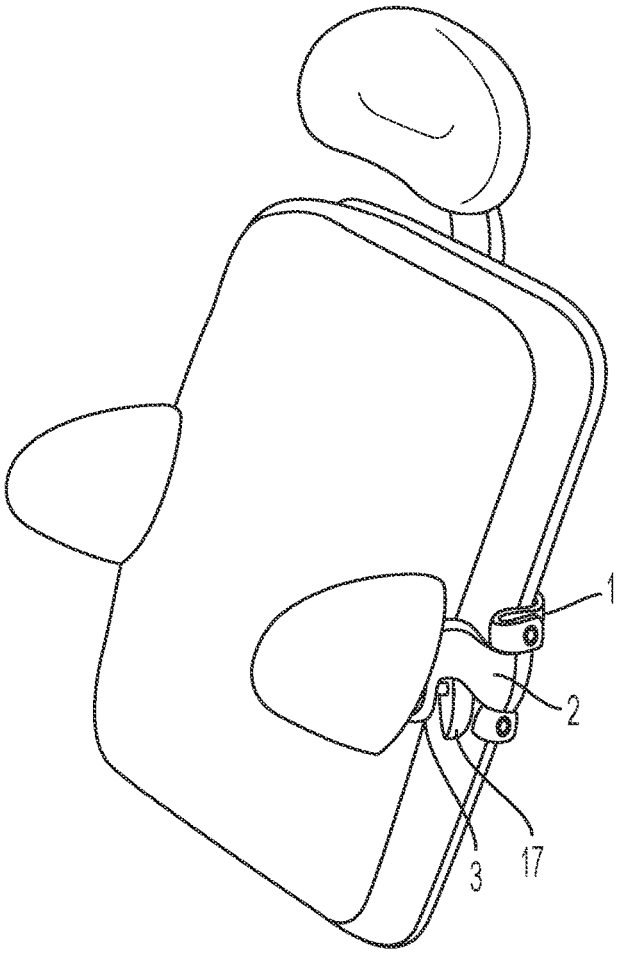
FIG. 6 is an isometric view of a wheelchair or disability seat incorporating the support.

Referring to FIG. 6, the plate 3 is padded and upholstered. As illustrated, there two such lateral supports, one either side of the wheelchair or disability seat.

Referring to FIG. 2, the lateral support has a lever 17 for locking and unlocking the hinge body 2 with respect to the bracket 1. The lever 17 incorporates a horizontal bolt 18 (which may be in separate parts), the rear end of which reversibly locates in an aperture or recess 19 of the pin 5, and the forward end of which is permanently located in a forward bore 20 of the hinge body. When the bolt 18 is within the pin 5 the hinge body 2 is obstructed from swinging about the pin 5. Put another way, the hinge body 2 is locked with respect to the bracket 1.

Figure 3:
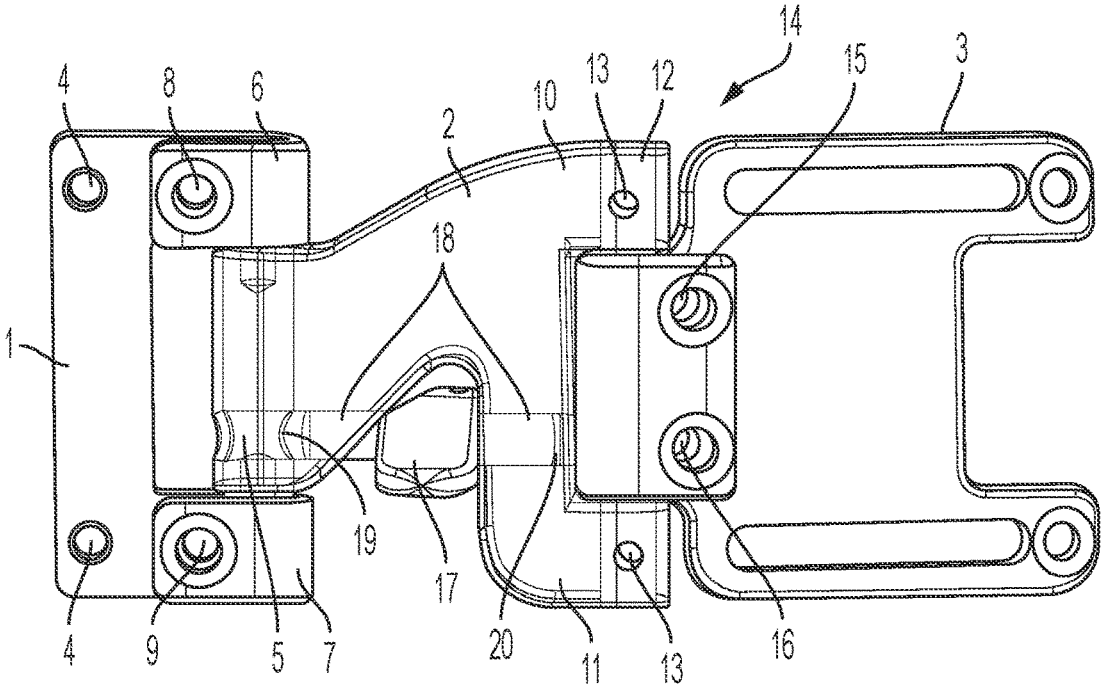
FIG. 3 is a further isometric partially internal view of the support, when in an unlocked state.
Figure 4:
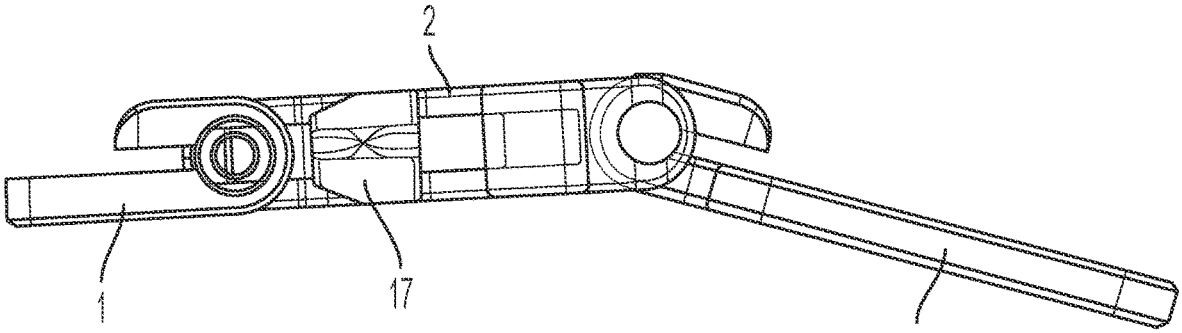
FIG. 4 is a plan view of the support when in the locked state.
Figure 5:
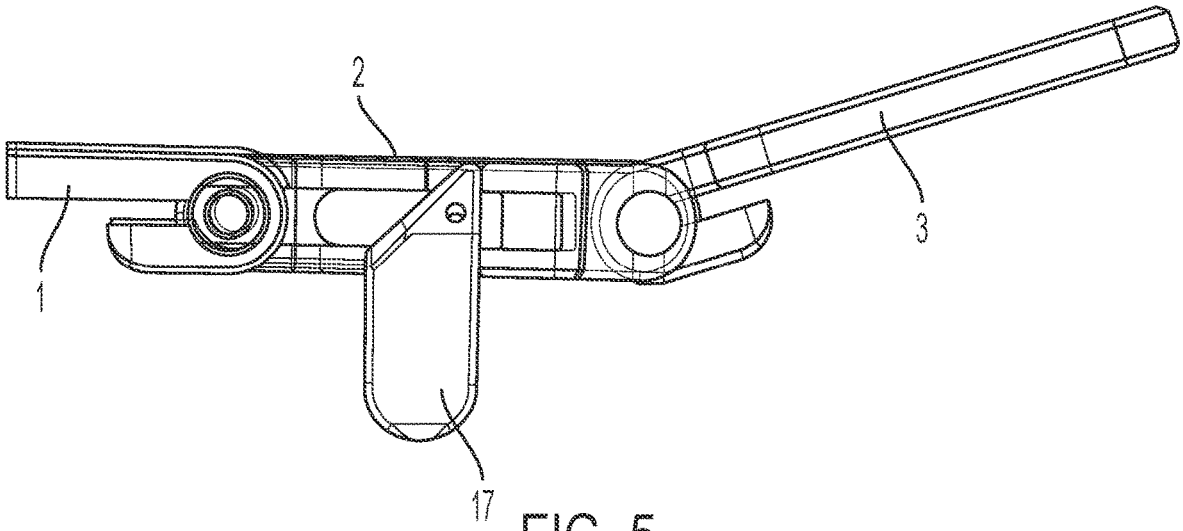
FIG. 5 is a plan view of the support when in the unlocked state.

Referring to FIG. 3, the hinge body 2 is unlocked by turning the lever 17 through 90°. This causes the lever's bolt 18 to move forward, out of the recess 19. When this occurs the hinge body 2 is free to pivot about the pin 5 to enable the lateral support to swing outwards to enable a patient to get into the seat without obstruction. It can subsequently be swung back when desired.

The forward end of the lever's bolt 18 is biased towards the locked position by a spring 23 in the bore 20 immediately to the right of the bolt. The spring urges the bolt 18 back into the pin 5 when the lever 17 is turned by hand back to the locked disposition of FIG. 2.

Referring to FIG. 2, the lever 17 has an angled cam face 21 that sits flush against an angled engaging surface 22 of the hinge body when the lever is in the locked position. The cam face 21 and the engaging surface 22 are angled similarly, although in other embodiments other types of complimentary relationship may be used (eg they do not have to be shaped or angled similarly). As the lever is turned through 90° to the unlocked position of FIG. 3 the lower part of the cam face 21 rides along the engaging surface 22 to pull the bolt 18 out of the pin 5. This can be subsequently reversed by turning the lever 17 back to its original position.

A particular benefit of the preferred embodiment is that a wheelchair or disability chair user can move swing the lateral support with only one hand, for example the same hand that turns the lever 17 can simultaneously push or pull on the lever to swing the hinge body 2 and the padded plate 3 collectively. This is more convenient than some known lateral supports where a user has to depress a button and hold it down with one hand, while pushing or pulling on the support with another hand to get the support to swing.

While some preferred embodiments have been described by way of example it should be appreciated that modifications and improvements can be made without departing from the scope of the following claims.

The invention claimed is:

1. A lateral support forming part of a seat, comprising:

a) a bracket;

b) a hinge body;

c) a forward support having padding; and d) a lever;

the lever arranged so it can be turned by hand to move a bolt into a first pin whereby the hinge body is prevented from swinging about the first pin, the lever also arranged so it can be subsequently turned by hand to cause a cam surface of the lever to ride along a complimentary surface of the hinge body to force the bolt from the first pin thereby freeing the hinge body to swing about the first pin and, as a consequence, to swing the forward support to facilitate access to the seat.

2. A lateral support according to claim 1, wherein the cam surface of the lever and the complimentary surface of the hinge body are similarly or identically angled.

3. A lateral support according to claim 1, wherein the first pin extends substantially vertically and the bolt extends substantially horizontally.

4. A lateral support according to claim 1, wherein the bolt is spring biased towards the first pin.

5. A lateral support according to claim 1, wherein the forward support can be swung about a second pin and releasably locked at a desired angle by fixing members.

6. A lateral support according to claim 1, wherein the forward support comprises a padded plate.

7. A lateral support according to claim 1, wherein the hinge body and the forward support can be collectively swung by applying a swinging force to the lever when the bolt has been forced from the first pin.

8. A lateral support according to claim 1, wherein the bracket has upper and lower legs that turn back on themselves and extend around upper and lower ends of the first pin and are tightened against the first pin by way of threaded fixing members.

9. A lateral support according to claim 5, wherein the hinge body has forwardly disposed upper and lower arms that turn back on themselves and extend around upper and lower ends of the second pin and are tightened against the second pin by way of threaded fixing members.

10. A lateral support according to claim 5, wherein:

a) the cam surface of the lever and the complimentary surface of the hinge body are at least similarly angled;

b) the first pin extends substantially vertically and the bolt extends substantially horizontally;

c) the bolt is spring biased towards the first pin;

d) the forward support can be swung about the second pin and releasably locked at a desired angle by fixing members;

e) the bracket has upper and lower arms that turn back on themselves and extend around upper and lower ends of the first pin and are tightened against the first pin by way of threaded fixing members; and f) the hinge body has forwardly disposed upper and lower arms that turn back on themselves and extend around upper and lower ends of the second pin and are tightened against the second pin by way of threaded fixing members.

* * * * *